US012396502B1

(12) United States Patent
Ernst

(10) Patent No.: US 12,396,502 B1
(45) Date of Patent: Aug. 26, 2025

(54) SELF DEFENSE GLOVE

(71) Applicant: Joe Ernst, Tell City, IN (US)

(72) Inventor: Joe Ernst, Tell City, IN (US)

( * ) Notice: Subject to any disclaimer, the term of this patent is extended or adjusted under 35 U.S.C. 154(b) by 0 days.

(21) Appl. No.: 18/886,043

(22) Filed: Sep. 16, 2024

(51) Int. Cl.
*A41D 19/015* (2006.01)
*A41D 19/00* (2006.01)

(52) U.S. Cl.
CPC ... *A41D 19/01594* (2013.01); *A41D 19/0037* (2013.01)

(58) Field of Classification Search
CPC ..... A41D 19/01594; A41D 19/0024; A41D 19/0031; A41D 19/0037
See application file for complete search history.

(56) References Cited

U.S. PATENT DOCUMENTS 824,925 A * 7/1906 Gosnell ..... D05B 91/04 30/162
2,895,139 A * 7/1959 Compton ..... A22C 25/006 452/121
3,587,591 A * 6/1971 Satterwhite ..... A61B 17/4208 30/298
3,593,803 A * 7/1971 Ibach ..... A41D 19/01594 2/21
3,872,514 A * 3/1975 Liebelt ..... A41D 19/01523 2/159
5,325,596 A * 7/1994 Baker ..... B26B 27/007 30/304
5,526,589 A * 6/1996 Jordan ..... A43C 15/14 36/134
5,644,796 A * 7/1997 Laughlin ..... A41D 19/01594 2/163
5,673,436 A * 10/1997 Piper ..... F41H 9/10 2/163
6,298,489 B1 * 10/2001 Cox ..... A41D 19/01594 2/163
6,643,845 B2 * 11/2003 O'Dea ..... A41D 19/01594 224/183
7,254,909 B2 * 8/2007 Ungari ..... A43C 15/14 36/61
8,347,509 B2 * 1/2013 Votolato ..... B25F 1/003 30/151
8,413,265 B1 * 4/2013 Hoppes ..... A41D 19/0037 2/160
9,060,554 B2 * 6/2015 Bullard ..... B25F 1/00
(Continued)

*Primary Examiner* — Alissa L Hoey
(74) *Attorney, Agent, or Firm* — GUGLIOTTA & GUGLIOTTA LPA

(57) ABSTRACT

A self-defense glove providing discreet, yet effective personal protection is disclosed. The glove integrates a concealed, rapidly deployable spike mechanism within its structure. A metal grommet positioned between the thumb and index finger leads to an internal cylindrical chamber housing a retractable metal spike. The spike features a pointed end for defense and a flat metal head for deployment. A magnetic system embedded in the glove's palm enables quick activation. In threatening situations, the wearer can deploy the spike by a simple hand movement, causing it to protrude vertically from the palm. The design prioritizes user safety, ease of concealment, and rapid deployment. Constructed with durable materials, these gloves offer a balance between everyday wearability and robust self-defense capability, providing an inconspicuous yet readily available means of self-defense.

11 Claims, 4 Drawing Sheets

(56) References Cited

U.S. PATENT DOCUMENTS

| | | | | |
|---|---|---|---|---|
| 9,091,504 | B2 * | 7/2015 | McDonald | F41B 15/06 |
| 9,987,758 | B2 * | 6/2018 | Levine | F41B 13/00 |
| 10,175,032 | B2 * | 1/2019 | Cooper | A41D 19/0031 |
| 10,264,872 | B2 * | 4/2019 | Kim | B25F 1/04 |
| 10,667,533 | B2 * | 6/2020 | Lugo | A22C 25/025 |
| 10,694,794 | B2 * | 6/2020 | Komperda | A41D 19/0037 |
| 11,033,061 | B2 * | 6/2021 | Braithwaite | A01B 1/06 |
| 11,143,484 | B2 * | 10/2021 | Deveau | A41D 19/01 |
| 11,172,717 | B2 * | 11/2021 | Reiter | A44B 17/0088 |
| 11,231,250 | B1 * | 1/2022 | Fisher | F41H 13/0081 |
| 11,565,431 | B2 * | 1/2023 | Levine | B26B 1/08 |
| 11,627,770 | B2 * | 4/2023 | McAllister | A41D 19/01594 2/160 |
| 11,731,030 | B2 * | 8/2023 | Marks | A63C 11/2224 280/821 |
| 11,745,372 | B1 * | 9/2023 | Truyenque | B26B 21/4075 2/160 |
| 2010/0236077 | A1 * | 9/2010 | Shirey | B26B 1/02 2/160 |
| 2010/0251552 | A1 * | 10/2010 | Gazcon | B26B 1/08 30/162 |
| 2012/0304471 | A1 * | 12/2012 | Jones | B26B 27/007 30/162 |
| 2017/0006942 | A1 * | 1/2017 | Del Valle | A41D 13/0012 |
| 2018/0249774 | A1 * | 9/2018 | Ohanian | A41D 13/087 |
| 2019/0184588 | A1 * | 6/2019 | Keelan | B26B 27/005 |
| 2022/0225708 | A1 * | 7/2022 | Javed | A41D 19/01594 |
| 2022/0248785 | A1 * | 8/2022 | Grace | A41D 19/01594 |
| 2023/0248091 | A1 * | 8/2023 | Hoffmann | B26B 27/007 2/160 |
| 2023/0284719 | A1 * | 9/2023 | Boyle | A46B 5/04 |
| 2024/0081447 | A1 * | 3/2024 | Neuberger | A41D 19/01594 |

* cited by examiner

SELF DEFENSE GLOVE

RELATED APPLICATIONS

There are no previously filed, nor currently any co-pending applications, anywhere in the world.

BACKGROUND OF THE INVENTION

1. Field of the Invention

The present invention relates to the field of personal protection equipment and, more specifically, to wearable self-defense devices that integrate concealed defensive mechanisms into everyday apparel for immediate accessibility and discreet carry.

2. Description of the Related Art

In today's society, personal safety remains a paramount concern for many individuals. The need for effective, accessible, and discreet self-defense tools has grown as people seek ways to protect themselves in potentially dangerous situations. Traditional self-defense methods and tools, while varied, often present limitations that this innovation seeks to address.

Pepper Sprays and Personal Alarms, while portable, require the user to carry a separate device, which may not always be immediately accessible in sudden confrontations. There is also a risk of accidental discharge or activation.

Tactical Pens or Kubotan are tools that can be effective but often require training to use properly. They may also draw unwanted attention or be restricted in certain settings due to their overt defensive nature.

Concealed Carry Firearms are effective; however, firearms are heavily regulated, require extensive training, and carry significant legal and safety implications. They are also not suitable or permissible in many everyday situations.

Martial Arts Training, while valuable, requires significant time investment and may not be feasible for all individuals, particularly those with physical limitations.

Standard Self-Defense Keychains or Jewelry, while discreet, often lack the robustness needed for effective defense and may not be immediately accessible when wearing certain types of clothing.

As can be seen, problems exist in the Current State of the Art. These include:

1. Accessibility: Many existing self-defense tools are not immediately available when needed, often stored in pockets or bags.
2. Discretion: There's a need for self-defense tools that don't appear threatening or draw attention during everyday activities.
3. Readiness: Current tools often require time to retrieve and prepare for use, which may not be available in sudden confrontations.
4. Versatility: Many tools serve a single purpose, either as protective gear or as a defensive weapon, but not both.
5. Legal and Social Acceptability: Some effective self-defense tools face legal restrictions or social stigma, limiting their practicality for everyday carry.
6. Ease of Use: Many current options require significant training or strength to use effectively, limiting their utility for a broad range of users.

These limitations in the current state of the art highlight a clear need for a self-defense solution that is: always readily accessible; discreet and socially acceptable for everyday wear; quickly deployable in emergency situations; dual-purpose, serving both as normal attire and a defensive tool; and, easy to use without extensive training; effective in deterring or defending against physical threats. Consequently, the need exists for effective, accessible, and discreet self-defense tools has grown as people seek ways to protect themselves in potentially dangerous situations.

SUMMARY OF THE INVENTION

It is thus an object of the present invention to provide a wearable self-defense device in the form of gloves that offer immediate access to a concealed defensive mechanism while maintaining the appearance and functionality of ordinary gloves, thereby enhancing personal safety without compromising discretion or everyday usability.

The self-defense gloves aim to address existing needs by integrating a concealed, rapidly deployable defensive mechanism into an everyday accessory. This innovation seeks to bridge the gap between accessibility, discretion, and effectiveness in personal protection tools, providing users with a practical solution that overcomes many of the limitations found in existing self-defense options.

The present invention provides a novel pair of self-defense gloves designed to provide discreet yet effective personal protection. The key innovation lies in a concealed, rapidly deployable spike mechanism integrated into each glove's structure. The gloves feature a fingertip-less design with a metal grommet positioned between the thumb and index finger. This grommet leads to an internal cylindrical chamber that houses a retractable metal spike. The spike, when not in use, remains hidden within this chamber, allowing the gloves to maintain a non-threatening appearance. A unique deployment mechanism utilizes a magnetic system embedded in the gloves' palms. In threatening situations, the wearer can quickly activate the spike by a simple hand movement, causing it to protrude vertically from the palm. This transformation allows the gloves to function as a defensive weapon, capable of deterring or countering physical attacks.

The design prioritizes user safety, ease of concealment, and rapid deployment. Constructed with durable materials, these gloves offer a balance between everyday wearability and robust self-defense capability. This invention represents a significant advancement in personal protection equipment, providing users with an inconspicuous yet readily available means of self-defense.

It is an advantage of the present invention that it provides immediate access to a self-defense mechanism without the need to reach for a separate device.

It is another advantage of the present invention that it maintains the appearance of ordinary gloves, allowing for discreet carry in various social and professional settings.

It is an advantage of the present invention that it offers dual functionality, serving both as protective hand wear and a self-defense tool.

It is another advantage of the present invention that it enables rapid deployment of the defensive mechanism through a simple, intuitive movement.

It is an advantage of the present invention that it can be worn continuously throughout the day, ensuring constant readiness for potential threats.

Another advantage of the present invention is that it does not require extensive training to use effectively, making it accessible to a wide range of users.

It is an advantage of the present invention that it provides a non-lethal self-defense option, reducing legal and ethical concerns associated with more severe weapons.

Another advantage of the present invention is that it allows for ambidextrous use, with the ability to deploy the defensive mechanism from either hand or both simultaneously.

It is an advantage of the present invention that it incorporate a deployment mechanism that inherently prevents accidental deployment during normal wear.

Another advantage of the present invention is that it can be customized to fit various hand sizes and style preferences while maintaining its defensive capabilities.

It is an advantage of the present invention that it provides a tactile deterrent option, potentially de-escalating threatening situations without the need for more severe defensive actions.

It is another advantage of the present invention that it offers a self-defense solution for environments where carrying obvious weapons or separate defensive tools may be prohibited or socially unacceptable.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
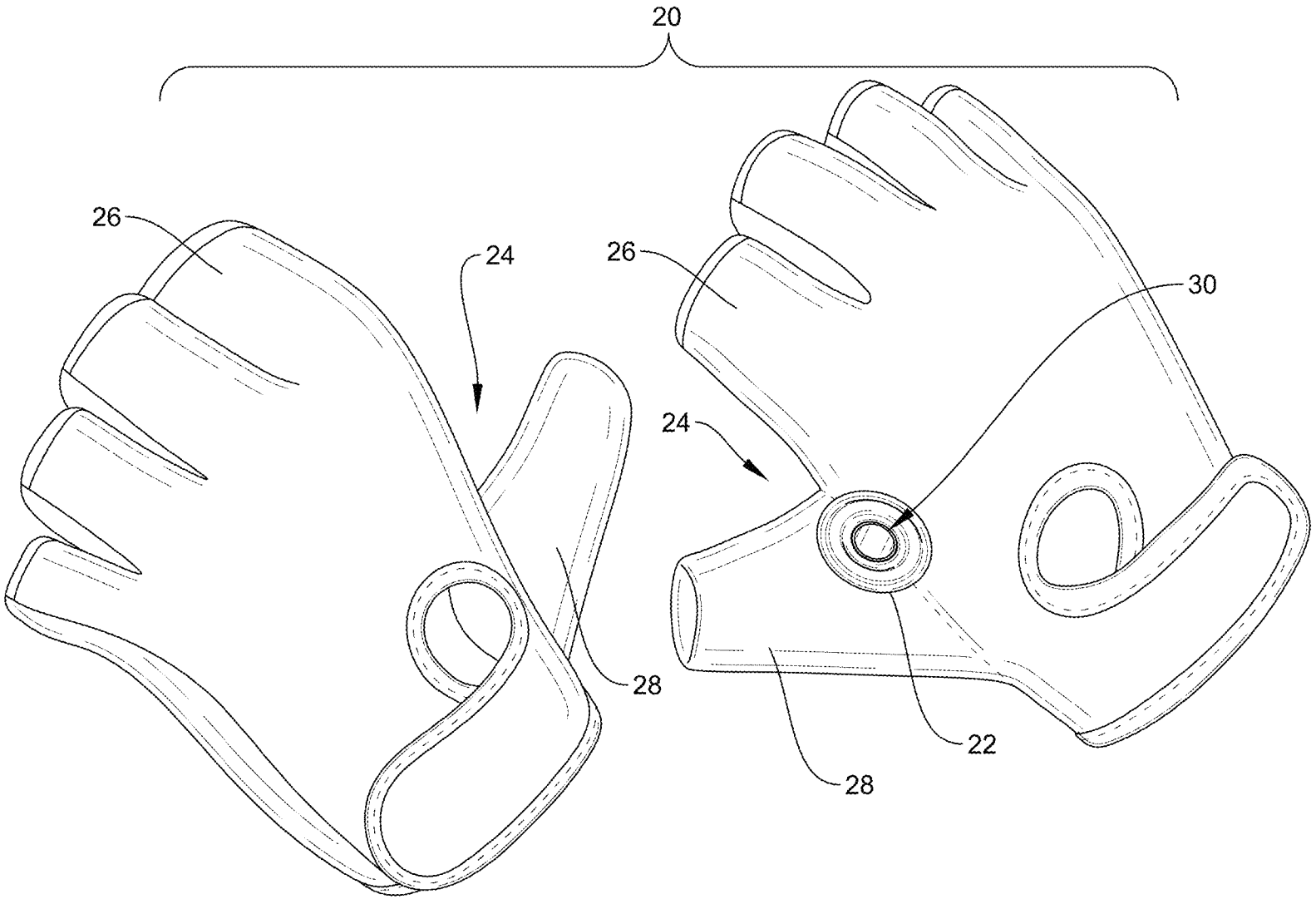
FIG. 1 is a top perspective view of a pair of gloves according to the preferred embodiment of the present invention.
Figure 2:
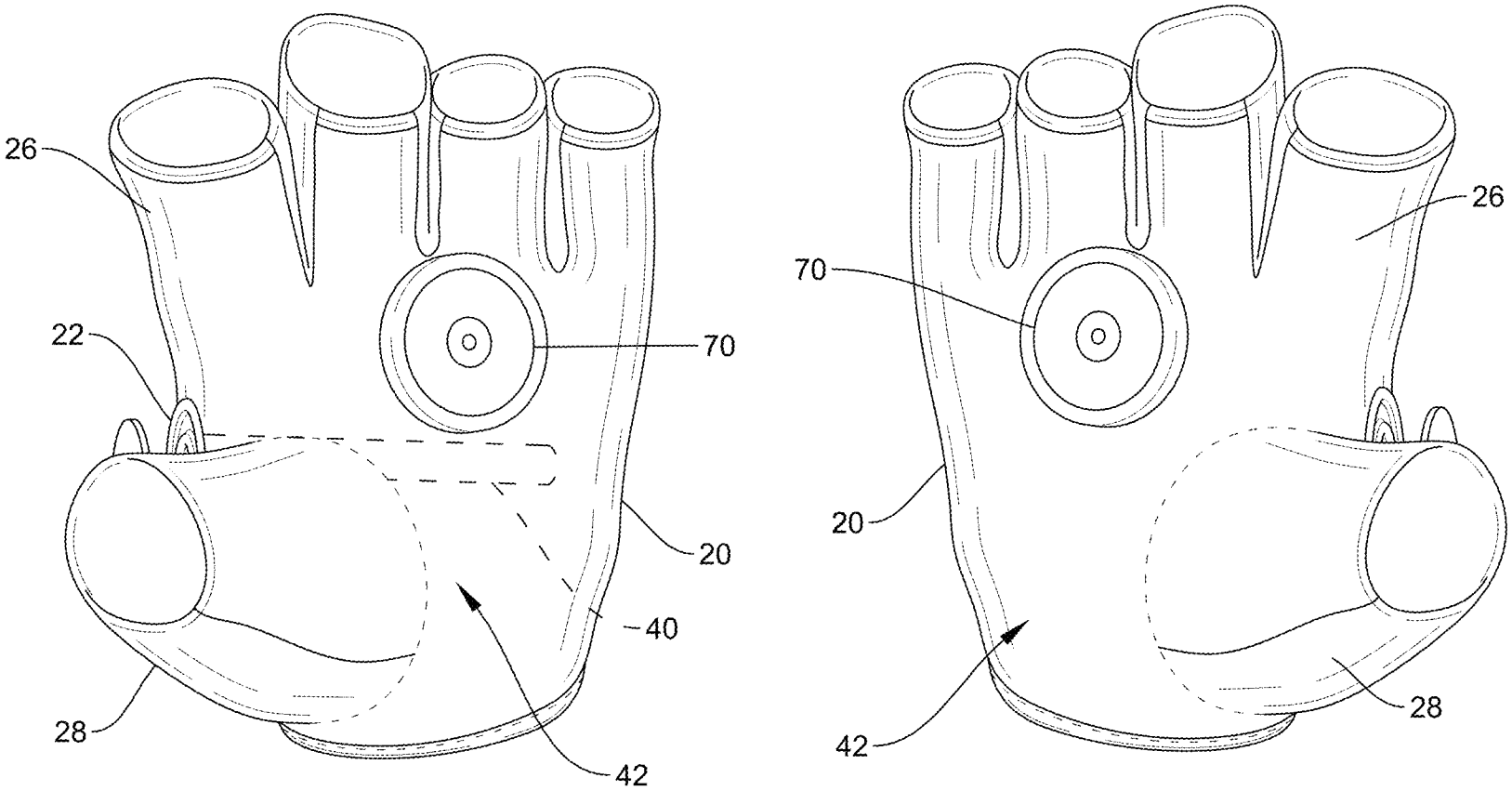
FIG. 2 is a bottom perspective view thereof.
Figure 3:
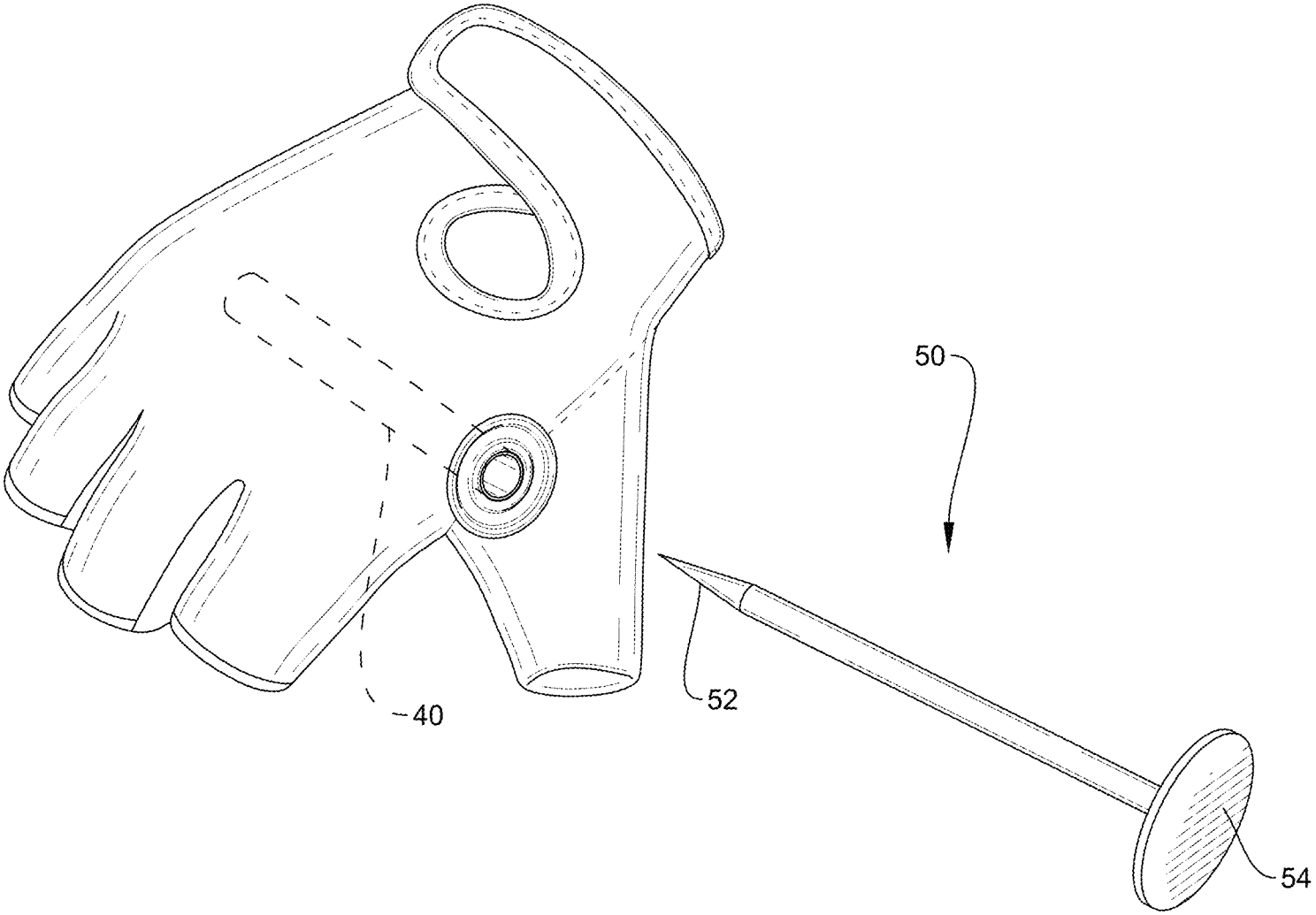
FIG. 3 is top perspective view of one glove 20 shown with a defensive spike 50 removed.
Figure 4:
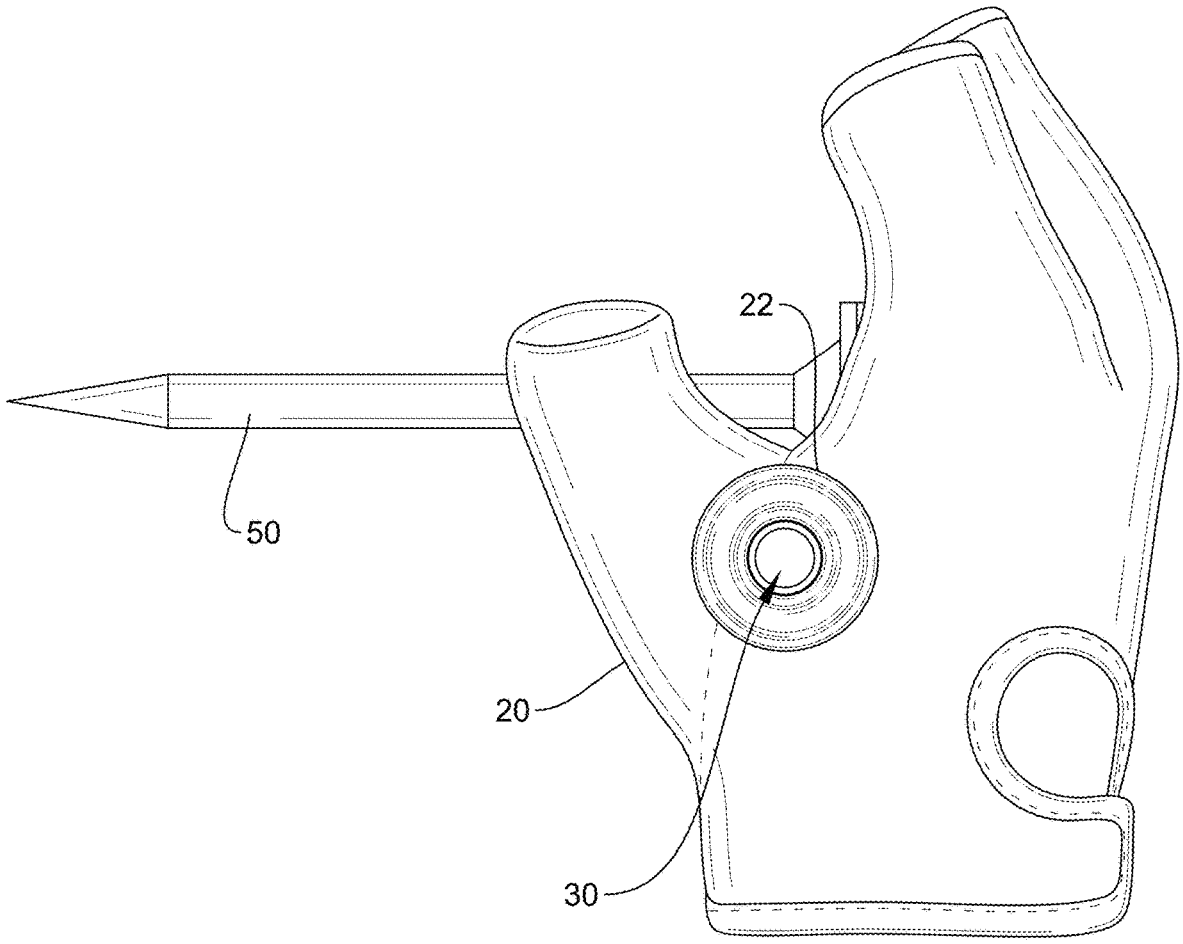
FIG. 4 is a side elevational view of a glove 20 showing a spike 50 attached and deployed for defensive use.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112 (f).

The best mode for carrying out the invention is presented in terms of its preferred embodiment, herein depicted within the Figures.

1. DETAILED DESCRIPTION OF THE FIGURES

Referring now to the drawings, wherein like reference numerals indicate the same parts throughout the several views, the invention comprises a pair of gloves designed for self-defense purposes, incorporating a concealed, deployable spike mechanism that can be rapidly activated in threatening situations.

The gloves 20 may be of a conventional construction or formed specialized for the present functionality. The gloves 20 may be constructed without fingertips, allowing for improved dexterity or warm weather use as shown. Alternately, a closed finger design may be utilized and appear as an otherwise conventional winter glove. A key feature of each glove 20 is a metal grommet 22 positioned at the web space 24 between the first finger 26 and thumb 28. This grommet 22 forms a central orifice 30 that serves as an access point to a protective cylindrical chamber 40. The chamber 40 extends down along the palm side 42 of the glove 20, positioned on the inside, and functions as a sheath designed to receive and conceal a pointed spike or shiv.

A spike mechanism 50 is provided featuring a pointed end 52 for defensive purposes and a wide, flat, thin metal "head" 54 at the opposite end. The spike 50 is securely attached at the center of the head 52, positioned perpendicular to the inner surface 56 of the head 54.

To enhance each glove's structure and functionality, a r flat, disc-shaped magnet 70 is securely fastened to the glove's palm 42, serving as an activation point for the spike mechanism. The material of the glove is sandwiched between the magnet and a backing washer.

In an alternate embodiment of the present invention, the self-defense gloves incorporate an electromagnetic system for spike deployment, enhancing the reliability and speed of the defensive mechanism. This embodiment replaces the permanent magnet in the palm area with an electromagnet powered by small, rechargeable batteries integrated into the glove's structure. The batteries are concealed within a reinforced compartment in the wrist area of the glove, ensuring they do not interfere with the glove's flexibility or comfort during normal wear. A miniature control circuit, also housed in the wrist area, manages the electromagnet's activation. To deploy the spike, the wearer presses a discreet, touch-sensitive switch located on the side of the index finger. This action instantly energizes the electromagnet, powerfully attracting the metal head of the spike and rapidly deploying it through the grommet. The electromagnetic system allows for more precise control over the deployment mechanism, potentially enabling features such as adjustable deployment force or electronic safety locks, further enhancing the gloves' functionality and safety.

2. OPERATION OF THE PREFERRED EMBODIMENT

In operation, the deployment process of the spike 50 is designed for quick and efficient use in threatening situations. In its default state, the spike 50 remains inserted into and concealed within the sheath 40 of the glove 20. To deploy the spike 50, the user brings their hands together and taps the magnet 70 on one palm with the flat head 54 of the spike 50 positioned over the grommet 22 of the other hand. The head 54 of the spike 50 attaches magnetically to the magnet 70 on the palm, and when the hands are pulled apart, the spike is deployed, protruding vertically upward from the user's palm. This action transforms the glove into a defensive weapon, capable of stabbing an attacker when the user pushes their hands outward with palms up and the spike deployed. The user has the option to activate this deployment mechanism for one or both gloves simultaneously. The only situation where deployment might be difficult is if the user cannot bring either hand next to the other (e.g. both hands restrained apart).

Safety and concealment are paramount in the design of these gloves. When not in use, the spikes remain hidden within the sheaths, ensuring safety and discretion. This design allows for quick deployment in threatening situations while maintaining a non-threatening appearance during normal wear. The materials used in the construction of these gloves are carefully selected to meet the demands of both functionality and durability. The gloves themselves are made from a durable fabric suitable for daily wear and capable of withstanding the forces involved in spike deployment. The grommet and spike are constructed from metal, carbon fiber, plastic, stainless, steel or a similarly durable material to ensure strength and durability, while the magnet is a strong, flat disc-shaped component capable of securely holding the spike head. The reinforcing strap is made of a robust material integrated into the glove structure to provide support for the magnet and maintain overall glove integrity.

The above outlines the key components and functionality of the self-defense gloves, providing a comprehensive overview of their design and operation. The innovative combination of concealment, rapid deployment, and effective defensive capability makes these gloves a unique and potentially valuable tool for personal protection.

The invention also includes complementary accessories to enhance the versatility of the self-defense system. These include:

Strap/hand band "JoZees": These provide a no-glove option for the defensive spike mechanism. The strap can be worn on the hand or attached to clothing, allowing for defensive capability even when gloves are not worn. This accessory has potential applications in various settings, including law enforcement uniforms.

Magnetic shiv holder: This accessory allows for the placement of defensive spikes in various locations such as car doors, cups, or any other desired area. This provides additional options for defensive readiness in different environments.

The spike mechanism itself can be manufactured from various materials to suit different needs and regulations, such as, by way of example, carbon fiber with a flat metal top, plastic with a flat metal top, or stainless steel with a flat metal top. These material options allow for customization based on factors such as weight, durability, and local regulations.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

What is claimed is:

1. A self-defense glove comprising:

a glove body;

a cylindrical chamber integrated within the glove body;

a reinforcing grommet positioned at a web space between a first finger and a thumb of the glove body, the grommet providing guided access to the cylindrical chamber and structured to facilitate rapid vertical deployment of a spike the spike configured to be housed within the cylindrical chamber;

a magnet embedded in a palm area of the glove body;

a backing washer, wherein the magnet is secured within the glove body using the backing washer to provide structural support to maintain the alignment and stability of the magnet during deployment; and wherein the spike is deployable through the grommet by magnetic attraction to the magnet.

2. The self-defense glove of claim 1, wherein the deployable spike comprises:

a pointed end; and a flat head at an opposite end, the flat head configured to magnetically attach to the magnet.

3. The self-defense glove of claim 1, wherein the glove body is fingerless.

4. The self-defense glove of claim 1, wherein the cylindrical chamber extends along a palm side of the glove body.

5. A pair of self-defense gloves, each glove comprising the self-defense glove of claim 1, wherein the spike is deployable from either of the gloves or both of the gloves simultaneously.

6. The self-defense glove of claim 1, wherein the spike, when deployed, protrudes vertically upward from the palm area of the glove body.

7. The self-defense glove of claim 1, wherein the grommet and the spike are constructed from material selected from the group: metal; carbon fiber; stainless steel; plastic; and a combination thereof.

8. A method of using a self-defense glove, the method comprising:

wearing the self-defense glove of claim 1;

positioning a flat head of the spike over the grommet of the glove for deployment;

tapping the flat head against the magnet in the palm area to magnetically attach the flat head to the magnet; and pulling the glove away from the flat head to deploy the spike through the grommet.

9. The self-defense glove of claim 1, wherein the spike is made from a material selected from the group consisting of: carbon fiber with a flat metal top; plastic with a flat metal top; and stainless steel with a flat metal top.

10. The self-defense glove of claim 1, wherein the magnet is an electromagnet powered by rechargeable batteries integrated into the glove body, and further comprising:

a control circuit managing the electromagnet's activation; and a touch-sensitive switch for deploying the spike.

11. The self-defense glove of claim 1, wherein a deployment mechanism prevents accidental deployment during normal wear by requiring a specific two-handed motion to activate.

* * * * *